US005914298A

United States Patent [19]

Karydas

[11] Patent Number: 5,914,298

[45] **Date of Patent: *Jun. 22, 1999**

[54] FLUORINATED LUBRICANTS FOR POLYETHYLENE SNOW SLIDERS

[76] Inventor: Athanasios Karydas, P.O. Box 20495, Cherokee Sta., New York, N.Y. 10021

[ * ] Notice: This patent issued on a continued prosecution application filed under 37 CFR 1.53(d), and is subject to the twenty year patent term provisions of 35 U.S.C. 154(a)(2).

[21] Appl. No.: 08/696,047

[22] Filed: Aug. 13, 1996

[51] Int. Cl.[6] ..... A63C 5/00; C10M 125/18; C10M 131/04

[52] U.S. Cl. ..... 508/106; 508/112; 508/450; 508/451; 508/548; 508/590; 280/601; 280/610

[58] Field of Search ..... 508/106, 590

[56] References Cited

U.S. PATENT DOCUMENTS

| | | | |
|---|---|---|---|
| 4,126,481 | 11/1978 | Sampson et al. | 106/191 |
| 4,724,093 | 2/1988 | Gambaretto | 252/58 |
| 5,114,482 | 5/1992 | Hertel | 106/270 |
| 5,131,674 | 7/1992 | Tokui et al. | 280/610 |
| 5,202,041 | 4/1993 | Traverso et al. | 252/58 |
| 5,409,622 | 4/1995 | Chapman et al. | 252/25 |
| 5,423,994 | 6/1995 | Traverso | 252/58 |
| 5,547,594 | 8/1996 | Karydas | 508/112 |
| 5,571,779 | 11/1996 | Kleiner et al. | 508/153 |
| 5,624,713 | 4/1997 | Ramer | 427/371 |

*Primary Examiner*—Ellen M. McAvoy
*Attorney, Agent, or Firm*—Helfgott & Karas, P.C.

[57] ABSTRACT

This invention relates to formulations useful as lubricants for polyethylene snow sliders such as skis, snowboards and sleds. Lubricants of this type are comprised of i) waxes, ii) carbon fluorides of which the basic structure is represented by the formula $CF_x$ wherein x has values ranging from 0.1 to 1.2 and, iii) fluorinated additives of the formula $$R_fX(CH_2)_mCH_3$$

wherein $R_f$ is independently a straight or branched perfluoroalkyl group; X is a direct bond, $SO_2NH$, $SO_2N(R)$ wherein R is an alkyl group of up to six carbon atoms, or X is an alkylene group of up to ten carbon atoms interrupted by one or more —O—, —$SO_2$—, or —S— groups; m is an integer from 4 to 30.

20 Claims, No Drawings

FLUORINATED LUBRICANTS FOR POLYETHYLENE SNOW SLIDERS

BACKGROUND OF THE INVENTION

This invention relates to formulations useful as lubricants for polyethylene snow sliders such as skis, snowboards and sleds. Lubricants of this type are of particular interest as ski waxes since they reduce friction between the polyethylene running surface of the ski and the snow, which results in higher skiing speeds.

A ski in motion possesses kinetic energy and the more of this energy it maintains, the faster it will move. Some of this energy is lost through friction and is converted to heat or is lost due to the vibration of the ski. Energy is also expended for plowing and compaction which occur when the snow is compressed or pushed aside as the ski is moving. The less energy a moving ski consumes through plowing and compaction, vibration and friction, the more kinetic energy—and consequently, speed—it retains.

There are several methods of minimizing kinetic energy loss. For example, to minimize kinetic energy loss due to plowing and compaction a race course is compacted mechanically prior to the race. Vibration, which is characteristic of the ski, is reduced by the proper utilization of ski construction materials.

Kinetic energy loss due to friction can also be minimized. The following friction components may be present in a glide situation:

1. Dry friction, which occurs in areas where dry snow particles touch the ski base;
2. Capillary suction, which occurs when free water is present and adheres to the base, producing a suction effect;
3. Friction due to the presence of dirt (i.e., diesel oil, pollen, rock-dust), which occurs when atmospheric contaminants adhere to the base and the snow at the same time, connecting them and reducing speed.
4. Friction due to static electricity, which is generated triboelectrically when the base slides on snow and increases the friction between the polyethylene (as well as the steel ski edges) and the snow.

Three main methods have been used to reduce kinetic energy loss due to friction:

A. Base structuring: Various textures are imprinted on the polyethylene ski bases by the manufacturers. Their purpose is to reduce capillary suction by preventing the formation of continuous water films and minimize the contact area between the base and the snow.

B. Inclusion of antistatic materials in the base: Up to 15% of graphite and carbon black are added to the polyethylene base materials to enhance its antistatic properties.

C. Waxing: Ski waxes are solid lubricants that reduce friction between the ski and the snow. When selecting a wax, one optimizes the following five properties:

1. Hardness—The wax must always be harder than the snow so the snow does not penetrate it.
2. Friction coefficient—The friction coefficient must be as low as possible.
3. Water repellency—Water repellency must be as high as possible to overcome capillary suction.
4. Dirt absorption—The wax must not absorb dirt, pollen or oily atmospheric contaminants.
5. Antistatic properties—The wax must not generate static electricity when rubbed.

Paraffins, microcrystalline waxes and synthetic (polyethylene or Fischer-Tropsch) waxes are typically used for ski wax formulation. Almost all ski waxes formulated for warm snow conditions are blends of soft paraffins and soft microcrystalline waxes. Blends of harder paraffins and microcrystalline waxes are used for more aggressive snow. Synthetic waxes are very effective wax blend hardeners so they are frequently added to wax formulations intended for use on very cold snow. The above hydrocarbon ski waxes have two disadvantages:

They generate static electricity when rubbed which attracts dirt and impairs glide.

They exhibit only moderate water repellency, so water capillary suction often reduces speed.

Graphite is often added to hydrocarbon waxes in amounts ranging from one to five percent by weight to impart antistatic properties and reduce dirt absorption. The generally accepted explanation is that graphite, being conductive, eliminates static electricity. Unfortunately, graphite also increases the internal friction of the wax which in turn reduces gliding speed. Graphite also reduces the hydrophobicity of paraffins which in turn impairs performance on wet snow. Therefore, the usefulness of graphite containing waxes is limited to racing on cold, dry snow and to long distance racing on very dirty snow where dirt absorption would significantly reduce speed.

Hydrocarbon-wax-miscible or dispersible fluorinated additives have been developed to improve the water repellency of hydrocarbon waxes. European Patent Application 0 421 303 A2 describes hydrocarbon wax miscible fluoroesters and polyfluoroalkyl ester copolymers for use as lubricants for skis; International Application WO 94/11468 describes hydrocarbon wax miscible perfluoroalkyl terminated urethane lubricants; U.S. Pat. No. 5,423,994 describes hydrocarbon wax miscible substituted alkanes of the formula $C_nH_{2n+1}C_mF_{2m+1}$. All of the aforementioned additives, however, are believed to increase static electricity build-up and, furthermore, are not suitable for snow temperatures below −10° C. FR 2637907 describes dispersions of a blend of carbon fluorides $(CF_x)_n$ in hydrocarbon wax. Although the carbon fluorides improve acceleration on colder snow, performance on wet snow is modest.

OBJECTS OF THE INVENTION

The present invention has been made in view of such drawbacks of the conventional water repellents and antistatic additives of the prior art.

An object of this invention is to provide formulations for substantially reducing the friction between a polyethylene snow slider and snow over a temperature range of at least 25° C.

A further object of this invention is to provide formulations exhibiting substantially reduced dirt absorption without reducing sliding speed.

A third object of this invention is to provide a lubricant that reduces friction between a polyethylene slider and snow and for the friction reduction to be effective for the duration of the sliding process.

SUMMARY OF THE INVENTION

It has now been unexpectedly discovered that blends comprised of i) waxes, ii) carbon fluorides of which the basic structure is represented by the formula $CF_x$ wherein x has values ranging from 0.1 to 1.2 and, iii) fluorinated additives of the formula $R_fX(CH_2)_mCH_3$ wherein $R_f$ is independently a straight or branched perfluoroalkyl group; X is a direct bond, $SO_2NH$, $SO_2N(R)$ wherein R is an alkyl group of up to six carbon atoms, or X is an alkylene group of up to ten carbon atoms interrupted by one or more —O—, —$SO_2$—, or —S— groups; m is an integer from 4 to 30, provide drastic reductions in friction between polyethylene sliding surfaces and all types of snow.

The lubricants of the invention can be produced in block form and can be applied on the polyethylene surface by rubbing or ironing. Alternatively, they can be formulated in the form of a paste using a suitable organic solvent and applied by brushing or polishing. The preferred solvents are petroleum distillates and are generally employed in an amount from about 30% to about 80% preferably from about 30% to about 50% based on the weight of the entire formulation. The lubricants of the invention are employed at a concentration from about 20% to about 80% and preferably from about 50% to about 70%.

Application of the lubricants of the invention on polyethylene surface can also be accomplished by impregnating paper, nonwovens and other substrates with the lubricant and transferring the lubricant to the polyethylene surface with a heated iron.

DETAILED DESCRIPTION OF THE INVENTION

The lubricants of the invention are blends comprised of i) waxes, ii) carbon fluorides of which the basic structure is represented by the formula $CF_x$ wherein x has values ranging from 0.1 to 1.2 and, iii) fluorinated additives of the formula $R_fX(CH_2)_mCH_3$ wherein $R_f$ is independently a straight or branched perfluoroalkyl group of 4 to 20 carbon atoms; X is a direct bond, $SO_2NH$, $SO_2N(R)$ wherein R is an alkyl group of up to six carbon atoms, or X is an alkylene group of up to ten carbon atoms interrupted by one or more —O—, —$SO_2$—, or —S— groups; m is an integer from 4 to 30.

Waxes comprise a broad group of opaque, water-repellent, essentially solid materials having varied chemical composition. Some waxes are natural in origin while others are synthesized by the chemical industry. Waxes are usually solids at room temperature, but they soften or become liquids at elevated temperatures. Chemically, they are relatively inert. They are soluble in petroleum solvents and are readily emulsifiable in water. Other properties they have in common include water repellency, moisture impermeability, low toxicity, and little odor. Commonly used waxes found in nature are directly derived from mineral, vegetable, animal, and insect sources. Mineral waxes such as montan, ozocerite, paraffin and microcrystalline waxes are all obtained from fossil sources. Montan is extracted from coal or lignite, ozocerite from shale, paraffin waxes are derived from the dewaxing of petroleum and microcrystalline waxes from residuum. The vegetable wax group includes carnauba, candelilla, sugarcane, and numerous other plant waxes. All these waxes exist in nature as coatings on leaves, stems, and trunks of plants and trees. They generally retain moisture in plants that are indigenous to tropical or arid areas. Carnauba wax is beaten from branches cut from the carnauba palm, which is cultivated in Brazil. Candelilla wax is obtained from the stem and leaves of a small perennial rush found in southern Texas and Mexico and is separated from the plant by immersion in hot water. Sugarcane wax is a by-product of sugar processing and is inferior in quality to carnauba wax. Beeswax is the widest-known and probably the longest-used among animal and insect waxes. Spermaceti is a wax extracted from the head cavity and blubber of sperm whales along with sperm oil. A number of synthetic waxy acids and polymers have wide application in both pure and blended form. Stearic and cetyl alcohol, chlorinated paraffins, ethylene oxide polymers, Fischer-Tropsch waxes, polyethylene, numerous synthetic glycerides, various other esters, and treated oils are but a few of the available synthetic materials.

Preferred waxes of the invention are paraffins, microcrystalline waxes, Fischer-Tropsch waxes, polyethylene waxes, carnauba, ozocerite, ethylene oxide polymers and blends containing two or more of the of the above waxes. More preferred waxes are paraffins, microcrystalline waxes, Fischer-Tropsch waxes, polyethylene waxes, carnauba and blends containing two or more of the of the above waxes. Most preferred waxes are paraffins, microcrystalline waxes, Fischer-Tropsch waxes, and blends containing two or more of the of the above waxes.

For the lubricant of the present invention the content of wax in the formulation may be from 50 to 99% and preferably from 85 to 97% from the viewpoint of the effects and economy. However, the content is not so limited.

Carbon fluorides of which the basic structure is represented by the formula $CF_x$ wherein x has values ranging from 0.1 to 1.2 can be synthesized by known methods from the direct fluorination of carbon or graphite in anhydrous hydrofluoric acid.

Preferred carbon fluorides of which the basic structure is represented by the formula $CF_x$ are those wherein x has values ranging from 0.3 to 1.2. More preferred carbon fluorides of which the basic structure is represented by the formula $CF_x$ are those wherein x has values ranging from 0.5 to 1.2. Most preferred carbon fluorides of which the basic structure is represented by the formula $CF_x$ are those wherein x has values ranging from 0.7 to 1.2.

For the lubricant of the present invention the content of carbon fluorides in the formulation may be from 0.1 to 5% and preferably from 0.2 to 1% from the viewpoint of the effects and economy. However, the content is not so limited.

Compounds of the formula $R_fX(CH_2)_mCH_3$ are well documented in the literature and can be synthesized by a wide variety of methods:

Compounds of the formula $R_fX(CH_2)_mCH_3$ wherein X is a direct bond can be synthesized by the following reaction scheme:

$$R_fI+CH_2{=}CH(CH_2)_{m-2}CH_3+\text{radical initiator}\rightarrow R_fCH_2CHI(CH_2)_{m-2}CH_3\ R_fCH_2CHI(CH_2)_{m-2}CH_3+\text{reducing agent}\rightarrow R_f(CH_2)_mCH_3$$

Compounds of the formula $R_fX(CH_2)_mCH_3$ wherein X is an alkylene group interrupted by —S— or —$SO_2$— groups can be synthesized by the following reaction scheme:

$$R_fCH_2\ \ CH_2SH+CH_2{=}CH(CH_2)_{m-2}CH_3+\text{radical initiator}\rightarrow R_fCH2CH_2S(CH_2)_mCH_3\ R_fCH2CH_2S(CH_2)_mCH_3+\text{oxidizing agent}\rightarrow R_fCH2CH_2SO_2(CH_2)_mCH_3$$

Compounds of the formula $R_fX(CH_2)_mCH_3$ wherein X is —$SO_2NR$— can be synthesized by the following reaction scheme:

$$R_fSO_2CI+RNH(CH_2)_mCH_3\rightarrow R_fSO_2NR(CH_2)_mCH_3$$

Preferred compounds of the formula $R_fX(CH_2)_mCH_3$ are those wherein X is a direct bond, or X is an alkylene group of up to six carbon atoms interrupted by one or more —O—, —$SO_2$—, or —S— groups; m is an integer from 8 to 30 and wherein $R_f$ is a straight or branched perfluoroalkyl group of 4 to 16 carbon atoms. More preferred compounds of the formula $R_fX(CH_2)_mCH_3$ are those wherein X is a direct bond, or X is an alkylene group of up to six carbon atoms interrupted by one —$SO_2$— or one —S— group; m is an integer from 12 to 24 and wherein $R_f$ is a straight or branched perfluoroalkyl group of 6 to 14 carbon atoms. Most preferred compounds of the formula $R_fX(CH_2)_mCH_3$ are those wherein X is a direct bond, or X is an alkylene group of five carbon atoms interrupted by one —S— group; m is an integer from 14 to 22 and wherein $R_f$ is a straight or branched perfluoroalkyl group of 6 to 12 carbon atoms.

The lubricant of the present invention contains wax, carbon fluoride and fluorinated additives as essential constituting components. Needless to say, conventional commonly employed additives may be incorporated thereto. Such additives include, for example, organic and inorganic fine particles such as polyethylene, polytetrafluoroethylene, alumina, silica, graphite, molybdenum disulflide, or titanium dioxide. In addition, a coloring agent such as a dye or a pigment, a lubricating agent such as a silicon compound or a polyolefin, and an additive such as a surfactant or an antioxidant may be mentioned.

In the following application descriptions, test descriptions and examples, all temperatures are given in degrees Centigrade, and all speeds are given in kilometers per hour. The examples are for illustrative purposes only.

DESCRIPTION OF TEST LUBRICANTS

The test lubricants were formulated by blending the waxes, fluorinated additives and carbon fluorides described in the following tables.

TABLE 1

| Waxes | | | |
|---|---|---|---|
| Formulation | Paraffin wax, m.p. 55° C. | Microcrystalline wax, m.p. 68° C. | Fischer-Tropsch wax, m.p. 105° C. |
| A | 85% | 15% | — |
| B | 90% | 10% | — |
| C | 60% | 20% | 20% |

TABLE 2

| Fluorinated Additives | |
|---|---|
| Designation | Structure |
| A | $C_8F_{17}C_2H_4SC_{21}H_{43}$ |
| B | $C_8F_{17}C_{18}H_{37}$ |
| C | $C_7F_{15}CO_2C_{18}H_{37}$ (described in EP 0 421 303 A2) |
| D | Adduct of two moles of $C_wF_{2w+1}CH_2CH_2OH$ wherein w has an average value of approximately 9 with one mole of isophorone diisocyanate (described in WO94/11468) |

TABLE 3

| Carbon Fluorides of Basic Structure $CF_x$ | | |
|---|---|---|
| Designation | x | color |
| A | 0.35 | black |
| B | 0.80 | dark gray |
| C | 1.00 | off-white |

To prepare the test lubricants, the waxes and fluorinated additives were melted together. Then, the carbon fluorides were added with stirring and the mixtures were poured into molds after having cooled to near their solidification temperatures.

DESCRIPTION OF LUBRICANT APPLICATION METHODS

The test waxes were applied on the ski base as follows: A bar of wax was placed on a waxing iron which was heated to no more than 120° C. and wax was dripped on the ski base. The iron was then used to distribute the wax uniformly on the ski base. The temperature of the iron was sufficiently high to melt the wax. Ironing time was typically two minutes per ski. The skis were allowed to cool for at least 20 minutes and preferably eight hours and the ski bases were scraped with a plastic scraper to remove excess wax. Further smoothing was achieved by brushing with a nylon brush.

DESCRIPTION OF TEST METHODS

Skiing speed evaluations were conducted on test courses, also referred to as glide tracks. Test speeds approximated those of actual competition and the length of the course was such that it could be covered in approximately 10 to 20 seconds. Multiple runs were conducted and the total time for the runs was recorded.

EXAMPLE 1

This example is comparative; it illustrates the superiority of the lubricants of the invention over prior art lubricants of the type described in FR 2637907, which do not contain fluorinated additives. The test conditions were as follows:

Snow temperature: −1° C.

Air temperature: +2° C.

Relative humidity: 79%

Typical skiing speed: 100 km/h

Skis: Alpine

Snow condition: Icy test track

| | Wax | | Fluorinated Additive | | Carbon Fluoride | | Total Glide | |
|---|---|---|---|---|---|---|---|---|
| Ski # | type | % in mix | type | % in mix | type | % in mix | Time, 6 runs | Rank |
| 1 | A | 99.5 | — | — | B | 0.5 | 61.68 sec | 3 |
| 2 | A | 89.5 | A | 10 | B | 0.5 | 60.66 sec | 1 |
| 3 | A | 89.5 | A | 10 | A | 0.5 | 61.43 sec | 2 |

EXAMPLE 2

This example is comparative and illustrates the superiority of the lubricants of the invention over lubricants which do not contain carbon fluoride. The test conditions were as follows:

Snow temperature: −12° C.

Air temperature: −10° C.

Relative humidity: 23%

Typical skiing speed: 60 km/h

Skis: Alpine

Snow condition: Fresh, dry snow

| | Wax | | Fluorinated Additive | | Carbon Fluoride | | Total Glide | |
|---|---|---|---|---|---|---|---|---|
| Ski # | type | % in mix | type | % in mix | type | % in mix | Time, 8 runs | Rank |
| 1 | C | 95 | A | 5 | — | — | 92.73 sec | 2 |
| 2 | C | 94.5 | A | 5 | B | 0.5 | 90.23 sec | 1 |

EXAMPLE 3

This example is comparative and illustrates the superiority of the lubricants of the invention over lubricants which contain graphite instead of carbon fluoride. The test conditions were as follows:

Snow temperature: −5° C.

Air temperature: −4° C.

Relative humidity: 57%

Typical skiing speed: 75 km/h

Skis: Alpine

Snow condition: Day-old, transforming snow

| | Wax | | Fluorinated Additive | | Graphite | Carbon Fluoride x = 1 | Total Glide | |
|---|---|---|---|---|---|---|---|---|
| Ski # | type | % in mix | type | % in mix | % | % | Time, 5 runs | Rank |
| 1 | B | 92.5 | B | 7 | 0.5 | — | 53.61 sec | 2 |
| 2 | B | 92.5 | B | 7 | — | 0.5 | 52.87 sec | 1 |

EXAMPLE 4

This example is comparative and illustrates the superiority of the lubricants of the invention over lubricants not containing carbon fluoride. The test was conducted as follows: The glide track was set up at the start of a two kilometer Nordic test loop. The glide performance was evaluated initially and after skating 10 km and 20 km. The test conditions were as follows:

Snow temperature: 0° C.

Air temperature: +9° C.

Relative humidity: 85%

Typical skiing speed: 25 km/h

Skis: Nordic

Snow condition: Very dirty glacier snow

| | Wax | | Fluorinated Additive | | Carbon Fluoride | | Glide Time (sec) | | |
|---|---|---|---|---|---|---|---|---|---|
| Ski # | type | % in mix | type | % in mix | type | % | Initial | After 10 km | After 20 km |
| 1 | B | 93 | B | 7 | — | — | 9.32 | 9.86 | 10.59 |
| 2 | B | 92.5 | B | 7 | C | 0.5 | 9.21 | 9.34 | 9.58 |

Visual inspection of the ski bases after skating 10 km and 20 km indicated that much more dirt had adhered to ski #1 than to ski #2.

EXAMPLE 5

This example is comparative and illustrates the superiority of the lubricants of the invention over formulations containing fluorinated additives described in the prior art. The test conditions were as follows:

Snow temperature: −12° C.

Air temperature: −10° C.

Relative humidity: 23%

Typical skiing speed: 60 km/h

Skis: Alpine

Snow condition: Fresh, dry snow

| | Wax | | Fluorinated Additive | | Carbon Fluoride | | Total Glide | |
|---|---|---|---|---|---|---|---|---|
| Ski # | type | % in mix | type | % in mix | type | % in mix | Time, 8 runs | Rank |
| 1 | C | 94.5 | A | 5 | B | 0.5 | 90.23 sec | 1 |
| 2 | C | 94.5 | B | 5 | B | 0.5 | 90.36 sec | 2 |
| 3 | C | 94.5 | C | 5 | B | 0.5 | 91.39 sec | 3 |
| 4 | C | 94.5 | D | 5 | B | 0.5 | 92.78 sec | 4 |

What is claimed is:

1. A lubricant for polyethylene snow sliders which comprises i) waxes, and ii) carbon fluorides of which the basic structure is represented by the formula $CF_x$ wherein x has values ranging from 0.1 to 1.2 and, iii) fluorinated additives of the formula $$R_fX(CH_2)_mCH_3$$

wherein $R_f$ is independently a straight or branched perfluoroalkyl group of 4 to 20 carbon atoms; X is a direct bond, $SO_2NH$, $SO_2N(R)$ wherein R is an alkyl group of up to six carbon atoms, or X is an alkylene group of up to ten carbon atoms interrupted by one or more —O—, —$SO_2$—, or —S— groups; m is an integer from 4 to 30.

2. A lubricant for polyethylene snow sliders as in claim 1, wherein x has values ranging from 0.1 to 1.2.

3. A lubricant for polyethylene snow sliders as in claim 1, wherein x has values ranging from 0.5 to 1.2.

4. A lubricant for polyethylene snow sliders as in claim 1, wherein X is a direct bond or X is an alkylene group of up to six carbon atoms interrupted by one or more —O—, —$SO_2$—, or —S— groups; m is an integer from 8 to 30 and wherein $R_f$ is a straight or branched perfluoroalkyl group of 4 to 16 carbon atoms.

5. A lubricant for polyethylene snow sliders as in claim 1, wherein X is a direct bond, or X is an alkylene group of up to six carbon atoms interrupted by one —$SO_2$— or one —S— group; m is an integer from 12 to 24 and wherein $R_f$ is a straight or branched perfluoroalkyl group of 6 to 14 carbon atoms.

6. A lubricant for polyethylene snow sliders as in claim 1, wherein X is a direct bond, or X is an alkylene group of five carbon atoms interrupted by one —S— group; m is an integer from 14 to 22 and wherein $R_f$ is a straight or branched perfluoroalkyl group of 6 to 12 carbon atoms.

7. A lubricant for polyethylene snow sliders as in claim 1, wherein the waxes are paraffins, microcrystalline waxes, Fischer-Tropsch waxes, polyethylene waxes, carnauba, ozocerite, ethylene oxide polymers and blends containing two or more of the of the above waxes.

8. A lubricant for polyethylene snow sliders as in claim 1, wherein the waxes are paraffins, microcrystalline waxes, Fischer-Tropsch waxes, polyethylene waxes, carnauba and blends containing two or more of the of the above waxes.

9. A lubricant for polyethylene snow sliders as in claim 1, blended with one or more of the following: polyethylene, polytetrafluoroethylene, alumina, silica, graphite, molybdenum disulflide, titanium dioxide, a coloring agent, a silicon compound, a polyolefin, a surfactant, an antioxidant.

10. A method for lubricating a polyethylene snow slider having a base surface for facing the snow in use of said snow slider, comprising the steps of:

a) at least partially removing extraneous materials, if any, that may have attached to said base surface;

b) coating at least a portion of said base surface with a lubricant which comprises i) waxes, and ii) carbon fluorides of which the basic structure is represented by the formula $CF_x$ wherein x has values ranging from 0.1 to 1.2 and, iii) fluorinated additives of the formula $$R_fX(CH_2)_mCH_3$$

wherein $R_f$ is independently a straight or branched perfluoroalkyl group of 4 to 20 carbon atoms; X is a direct bond, $SO_2NH$, $SO_2N(R)$ wherein R is an alkyl group of up to six carbon atoms, or X is an alkylene group of up to ten carbon atoms interrupted by one or more —O—, —$SO_2$—, or —S— groups; m is an integer from 4 to 30.

11. A method as in claim 10, wherein said polyethylene snow slider is one of a ski, snowboard and sled.

12. A method as in claim 10, wherein x has values ranging from 0.1 to 1.2.

13. A method as in claim 10, wherein x has values ranging from 0.5 to 1.2.

14. A method as in claim 10, wherein X is a direct bond or X is an alkylene group of up to six carbon atoms interrupted by one or more —O—, —$SO_2$—, or —S— groups; m is an integer from 8 to 30 and wherein $R_f$ is a straight or branched perfluoroalkyl group of 4 to 16 carbon atoms.

15. A method as in claim 10, wherein X is a direct bond, or X is an alkylene group of up to six carbon atoms interrupted by one —$SO_2$— or one —S— group; m is an integer from 12 to 24 and wherein $R_f$ is a straight or branched perfluoroalkyl group of 6 to 14 carbon atoms.

16. A method as in claim 10, wherein X is a direct bond, or X is an alkylene group of five carbon atoms interrupted by one —S— group; m is an integer from 14 to 22 and wherein $R_f$ is a straight or branched perfluoroalkyl group of 6 to 12 carbon atoms.

17. A method as in claim 10, wherein the waxes are paraffins, microcrystalline waxes, Fischer-Tropsch waxes, polyethylene waxes, carnauba, ozocerite, ethylene oxide polymers and blends containing two or more of the of the above waxes.

18. A method as in claim 10, wherein the waxes are paraffins, microcrystalline waxes, Fischer-Tropsch waxes, polyethylene waxes, carnauba and blends containing two or more of the of the above waxes.

19. A method as in claim 10, wherein said lubricant is in a blend with one or more of the following: polyethylene, polytetrafluoroethylene, alumina, silica, graphite, molybdenum disulflide, titanium dioxide, a coloring agent, a silicon compound, a polyolefin, a surfactant, an antioxidant.

20. A lubricant for polyethylene snow sliders as in claim 1 wherein X in the fluorinated additives of the formula $R_fX(CH_2)_mCH_3$ is an alkylene group of up to ten carbon atoms interrupted by one or more —O—, —$SO_2$—, or —S— groups; and m is an integer from 4 to 30.

* * * * *